US010744553B2

(12) United States Patent
Vil et al.

(10) Patent No.: US 10,744,553 B2
(45) Date of Patent: Aug. 18, 2020

(54) ROLLED STAINLESS STEEL OBJECT AND MANUFACTURING METHOD THEREFOR

(71) Applicant: APERAM, Luxembourg (LU)

(72) Inventors: Didier Vil, Aire / Lys (FR); Jean Michel Damasse, Lomme (FR); Françoise Haegeli, Achères (FR)

(73) Assignee: APERAM, Luxembourg (LU)

( * ) Notice: Subject to any disclaimer, the term of this patent is extended or adjusted under 35 U.S.C. 154(b) by 243 days.

(21) Appl. No.: 15/735,535

(22) PCT Filed: Jun. 10, 2015

(86) PCT No.: PCT/IB2015/054390

§ 371 (c)(1),
(2) Date: Dec. 11, 2017

(87) PCT Pub. No.: WO2016/198915

PCT Pub. Date: Dec. 15, 2016

(65) Prior Publication Data

US 2018/0169739 A1 Jun. 21, 2018

(51) Int. Cl.

| | |
|---|---|
| ***B21B 1/22*** | (2006.01) |
| ***B21H 8/00*** | (2006.01) |
| ***B21B 3/02*** | (2006.01) |

(52) U.S. Cl.

CPC ..... *B21H 8/005* (2013.01); *B21B 1/227* (2013.01); *B21B 3/02* (2013.01)

(58) Field of Classification Search

None

See application file for complete search history.

(56) References Cited

U.S. PATENT DOCUMENTS

| | | | |
|---|---|---|---|
| 2,277,725 | A | 3/1942 | Smith et al. |
| 3,956,915 | A | 5/1976 | Saunders |
| 2005/0000262 | A1 | 1/2005 | Schreiber et al. |
| 2005/0066701 | A1 | 3/2005 | Halliday et al. |

FOREIGN PATENT DOCUMENTS

| | | | |
|---|---|---|---|
| CN | 101509131 | A | 8/2009 |
| CN | 103080385 | A | 5/2013 |
| CN | 104626865 | A | 5/2015 |
| EP | 2881194 | A1 | 6/2015 |
| JP | H01118301 | A | 5/1989 |
| JP | H79007 | A | 1/1995 |
| JP | 2002361303 | A | 12/2002 |

(Continued)

*Primary Examiner* — Daniel J. Schleis

(74) *Attorney, Agent, or Firm* — Knobbe, Martens, Olson & Bear, LLP

(57) ABSTRACT

A rolled stainless steel object has surface with a raised and indented pattern including a random juxtaposition of at least two types of polygons. Each of the polygons has at least three sides, and is made up of substantially parallel rectilinear scratches, having a depth of from 5 to 30 μm separated by ridge lines, the axes of which are from 0.1 to 0.3 mm from each other, and a Fourier transform spectral analysis of which, carried out on a square of at least 100 $mm^2$, shows that they have an isotropy of at least 40% between the rolling direction and the sideways direction, and two adjacent preferred angular orientations of which scratches, from among the three main preferred angular orientations thereof, are spaced apart by a minimum of 20° and a maximum of 60°.

6 Claims, 14 Drawing Sheets

(56) References Cited

FOREIGN PATENT DOCUMENTS

| | | | |
|---|---|---|---|
| JP | 2004136344 | A | 5/2004 |
| JP | 2005131643 | A | 5/2005 |
| JP | 2012130966 | A | 7/2012 |
| JP | 2013-244526 | A | 12/2013 |
| JP | 5697098 | B2 | 2/2015 |

Isotropy : 11.6 %
First Direction : 0.289°
Second Direction : 5.48°
Third Direction : 174°

Isotropy : 4.92 %
First Direction : 130°
Second Direction : 136°
Third Direction : 123°

Isotropy : 7.08 %
First Direction : 0.0729°
Second Direction : 171°
Third Direction : 166°

Isotropy : 53.3 %
First Direction : 99.2°
Second Direction : 121°
Third Direction : 77.0°

Isotropy : 60.5 %
First Direction : 101°
Second Direction : 155°
Third Direction : 125°

ROLLED STAINLESS STEEL OBJECT AND MANUFACTURING METHOD THEREFOR

CROSS-REFERENCE TO RELATED APPLICATIONS

This application is the U.S. National Phase under 35 U.S.C. § 371 of International Application PCT/IB2015/054390, filed Jun. 10, 2015. The disclosures of the above-described application are hereby incorporated by reference in their entirety.

FIELD OF THE INVENTION

The present invention relates to the field of stainless steels in the form of rolled flat products, in particular strips, plates and sheets, or products cut and/or shaped from such strips, plates and sheets.

BACKGROUND OF THE INVENTION

Stainless steels are used in a large number of fields to form objects intended to remain visible and to have a clean surface appearance that is visually attractive through its brightness. This is in particular the case when they are used to manufacture furniture, household appliances, cutlery, building façade cladding, etc.

However, they have the drawback of making fingerprints left by the users of the objects in question highly visible, such that the surfaces of these objects must be cleaned regularly so as to benefit fully from the aesthetic properties of the stainless steel.

Various technical solutions have already been designed to alleviate this problem. Varnishes thus exist that are deposited by varnishing the surface of the stainless steel, and that make fingerprints visible only if the object is viewed from specific angles. However, this solution is not ideal, since it does not fully resolve the problem, given that the fingerprints remain visible under certain viewing conditions. Additionally, this varnish must be deposited during a specially dedicated manufacturing operation, which inevitably significantly increases the production cost of the object, and deteriorates the productivity of the production line of the objects, or that of the precursor semi-finished products (strips, plates, sheets or the like) from which they are derived. For the anti-fingerprint effect to remain, the layer of varnish also must not be significantly deteriorated over the course of the use of the object, which is not guaranteed when the object may be subject to friction during use (for example, knives, kitchen work surfaces, etc.). Lastly, the coating may be deteriorated if, after it is applied, the treated object must undergo shaping by stamping, bending or the like. Additionally, applying the coating only after shaping is not always possible or easy.

SUMMARY OF THE INVENTION

The aim of the invention is to offer the manufacturers of stainless steel or stainless steel objects rolled products that are not sensitive to fingerprints, in a manner guaranteed to be sustainable, without overly affecting the production time and cost of the objects or semi-finished products from which they are derived.

To that end, the invention relates to a rolled stainless steel object, characterized in that the surface thereof has a raised and indented pattern including a random juxtaposition of at least two types of polygons, each of said polygons having at least three sides, a surface area of between 1 and 9 $mm^2$, and a difference between its smallest and largest dimensions of between 0.5 and 3 mm, each polygon being made up of substantially parallel rectilinear scratches, each separated by ±15° relative to the mean orientation of the scratches, having a depth of from 5 to 30 μm separated by ridge lines, and the axes of which are from 0.1 to 0.3 mm from each other, and a Fourier transform spectral analysis of which, carried out on a square of at least 100 $mm^2$, shows that they have an isotropy of at least 40% between the rolling direction and the sideways direction, and two adjacent preferred angular orientations of which scratches, from among the three main preferred angular orientations thereof, are spaced apart by a minimum of 20° and a maximum of 60°.

Preferably, the reference plane of each polygon is inclined relative to the reference planes of its adjacent polygons, from 1 to 10°.

Preferably, the spectral analysis of its surface has between three and eight preferred angular orientations.

Preferably, the flanks of said scratches have curved surfaces and/or surfaces including unevenness.

This may involve a sheet, plate or strip.

The object may have been made by cutting and/or shaping a sheet, plate or strip of the preceding type, making up a precursor of said object.

The invention also relates to a method for manufacturing an object of the preceding type, characterized in that said surface having said pattern is obtained during the rolling of the object, or a precursor of said object, by the pressure of a rolling cylinder on the surface of the object or its precursor, said cylinder in turn having, on its surface, a pattern making it possible to obtain said pattern on the surface of the object.

As will have been understood, the invention consists of imparting, during a rolling operation, on the surface of the object, or on the surface of a semi-finished product that will be a precursor for said object, an etched raised and indented pattern of a particular, well-defined type. This pattern is based on a random juxtaposition of at least two types of polygons, not necessarily regular, having at least three sides. The planes of the surfaces of adjacent polygons are preferably slightly inclined relative to one another. The polygons in turn each delimit an area where substantially parallel scratches with defined depths and widths are present. They each have a surface comprised between 1 and 9 $mm^2$, a difference between their smallest dimension and their largest dimension comprised between 0.5 and 3 mm, and the reference plane of each polygon is inclined from 1 to 10° relative to that of its immediately adjacent polygons.

Each polygon is made up of substantially parallel scratches, i.e., each separated by ±15° relative to the mean orientation of the scratches. They are from 5 to 30 μm deep and are separated by ridge lines. Their axes are separated by 0.1 to 0.3 mm. A Fourier transform spectral analysis of the surface of the object, done on a square of at least 100 $mm^2$, shows that it has an isotropy of at least 40% between the rolling direction and the crosswise direction, and among the three main preferred angular orientations determined by the spectral analysis, two adjacent orientations are spaced apart from 20 to 60°.

Preferably, the pattern printed on the surface of the object has between three and eight preferred angular orientations. Beyond eight such preferred orientations, it is no longer guaranteed that the angular deviation between two adjacent preferred orientations will still be sufficient for the desired effect of alleviating fingerprint marks to be correctly obtained.

The depth of the scratches from 5 to 30 μm is justified by the fact that below 5 μm, the impression would be too difficult to perform and its result would in any case not be effective enough. Above 30 μm, the obtained anti-fingerprint effect is not significantly improved, and there is a risk of ending up with a sheet roughness that may be excessive for some applications. The etching of the roller cylinders with such a roughness level would also be problematic.

The inventors have also tested other types of etching of the surface of stainless steel sheets. One example of another such type of etching will be described later. However, it has been shown that the type of etching according to the invention was the most suitable, among those tested, for giving the surface the isotropy and multidimensional reflection particularities that make it possible to best resolve the problem of fingerprint visibility.

This impression is produced by the work cylinder of the roller, which comes into contact with the surface to be treated. This cylinder in turn has, on its surface, an etched pattern that is at least approximately the "negative" of the pattern that one wishes to etch on the surface of the object. It is necessary to roll without polishing; the indentations of the surface of the object are imparted by the corresponding raised portions arranged on the cylinder, and the raised portions of the surface of the object are imparted by the corresponding indentations arranged on the cylinder. The degree of identity between the dimensions of the patterns of the cylinder and the pattern to be imparted, in particular regarding the dimensions of the raised/indented parts of the cylinder, must be determined by experience, and may vary depending on the respective hardnesses of the surfaces of the cylinder and the surface to be treated and based on the intensity of the pressure applied to the surface by the cylinder.

If only one of the surfaces of the rolled object must be treated, it is of course only necessary to use one work cylinder having, on its surface, the negative etching of the pattern to be imparted. If both of the surfaces of the rolled object must be treated, both work cylinders of the roller must have this negative etching. The roller can be of any known type, traditional with a pair of work cylinders and one or several pairs of support cylinders, or for example of the Sendzimir type, or a planetary-type roller.

The cylinders in turn are etched using an industrial method such as laser etching, electro-erosion, etc.

BRIEF DESCRIPTION OF THE DRAWINGS

The invention will now be described more precisely, in reference to the following appended figures.

DETAILED DESCRIPTION OF THE PREFERRED EMBODIMENTS

Figure 1:
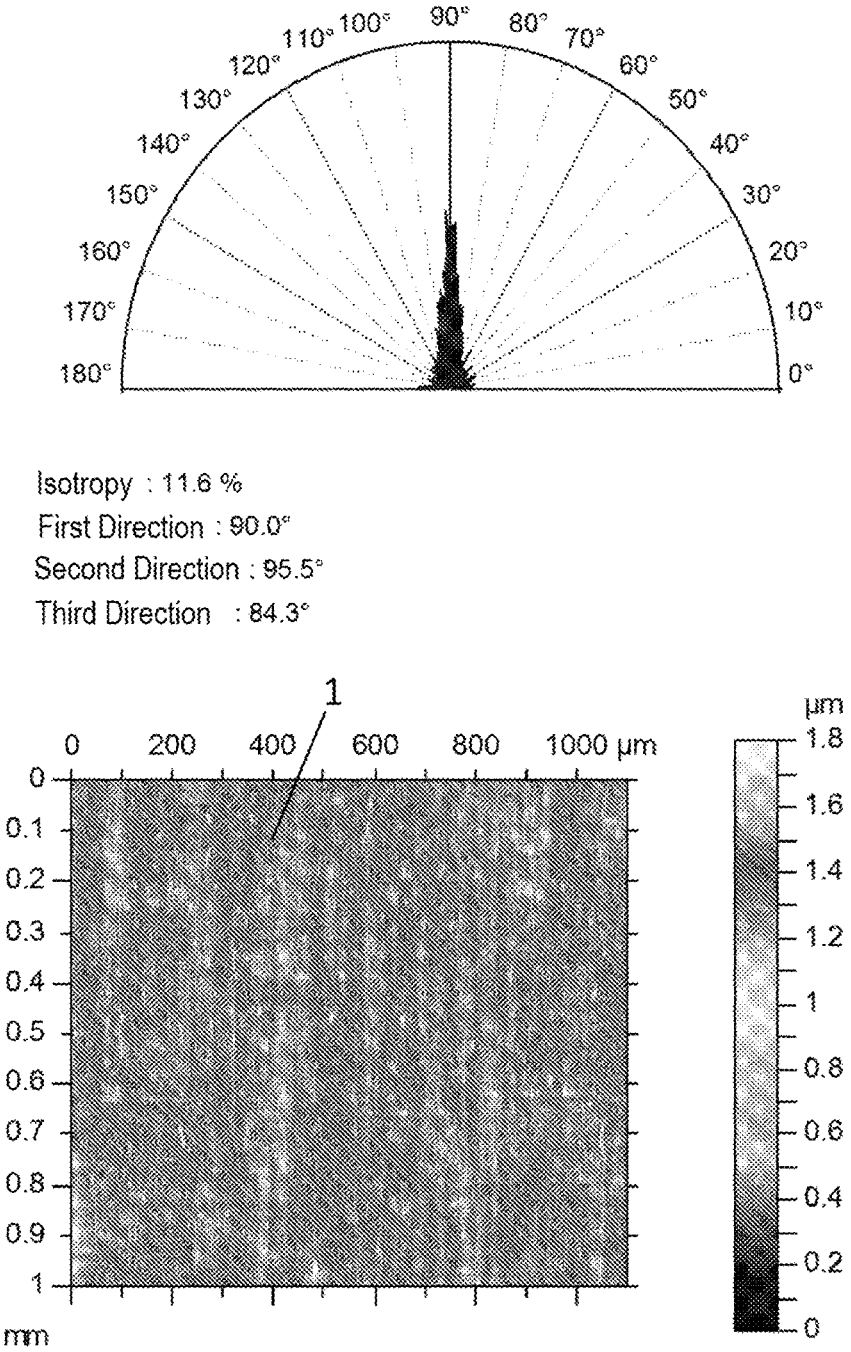
FIG. 1 and FIG. 2, which show the surface of an unetched stainless steel sheet of the prior art, and its spectral analysis diagram, using, as reference direction, the rolling direction (FIG. 1) and the crosswise direction (FIG. 2)
Figure 2:
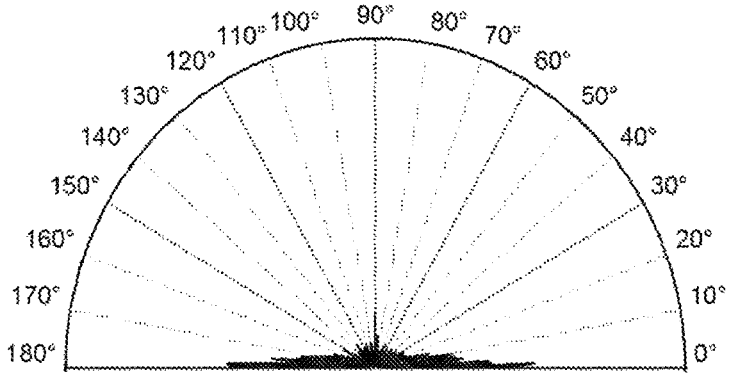
Figure 2:
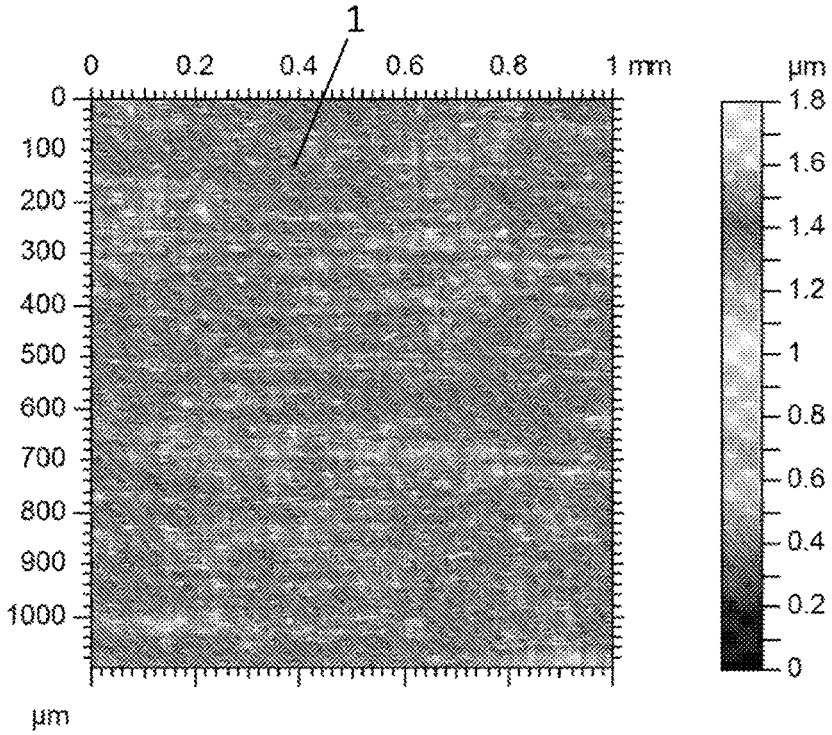

As references, FIGS. 1 and 2 show sample surfaces of a stainless steel sheet 1 rolled with stainless steel smooth work cylinders, as is typically the case, and which therefore did not have any particular etching. The surfaces of the sheet samples are themselves relatively smooth: only shallow (about 1 to 1.5 μm) and very narrow scratches can be seen, oriented cleanly along the rolling direction, and their Fourier transform spectral analysis diagrams, done using a traditional method (for example, see document "Techniques de l'Ingénieur, La transformée de Fourier et ses applications" [Engineering Techniques, The Fourier transform and its applications], 2007, vol. AFM3, AF1440-1443), are present. In the example of FIG. 1, the analysis is done using, as reference orientation (90°), the rolling direction, and in the example of FIG. 2, the analysis is done using, as reference orientation, the crosswise direction, i.e., the direction perpendicular to the rolling direction.

The isotropy rate between rolling direction and crosswise direction is identical for both images, which is logical since it involves the same sheet, and is 11.6%. This is a low rate, which is normal, since no particular measures were taken in order for the effect of rolling of the sheet on the surface structure to be alleviated, this rolling being carried out in a clearly defined direction. This very low isotropy of the surface is a drawback for the visibility of fingerprints, since it favors the reflection of the light in clearly defined directions in which the fingerprint is particularly visible.

Observed in the rolling direction (FIG. 1), the scratches have favored directions of 90.0°, 95.5° and 84.3° relative to the crosswise direction (the 0° and 180° angles corresponding to the two directions of the crosswise direction), which are therefore identical or very close to the rolling direction.

Observed in the crosswise direction (FIG. 2), the scratches have favored directions of 0.289°, 5.48° and 174° relative to the crosswise direction, and which are therefore very substantially perpendicular to the crosswise direction and therefore correspond to the rolling direction. The coherence of the results of the measurements of FIGS. 1 and 2 is therefore reasonably well ensured, to within the usual measuring imprecisions.

Figure 3:
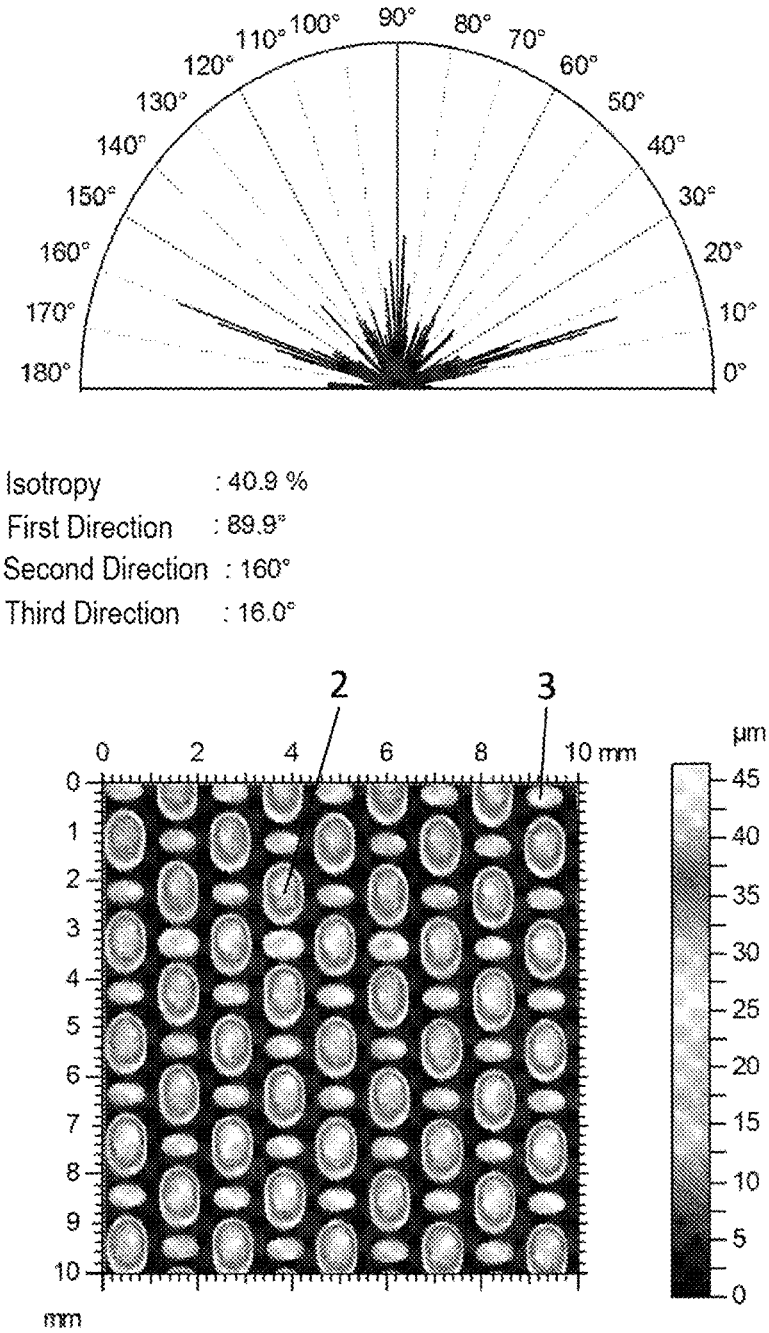
FIGS. 3 and 4, which show the surface of a stainless steel sheet etched in a manner not according to the invention, and its spectral analysis diagram, using the rolling direction as reference direction.
Figure 4:
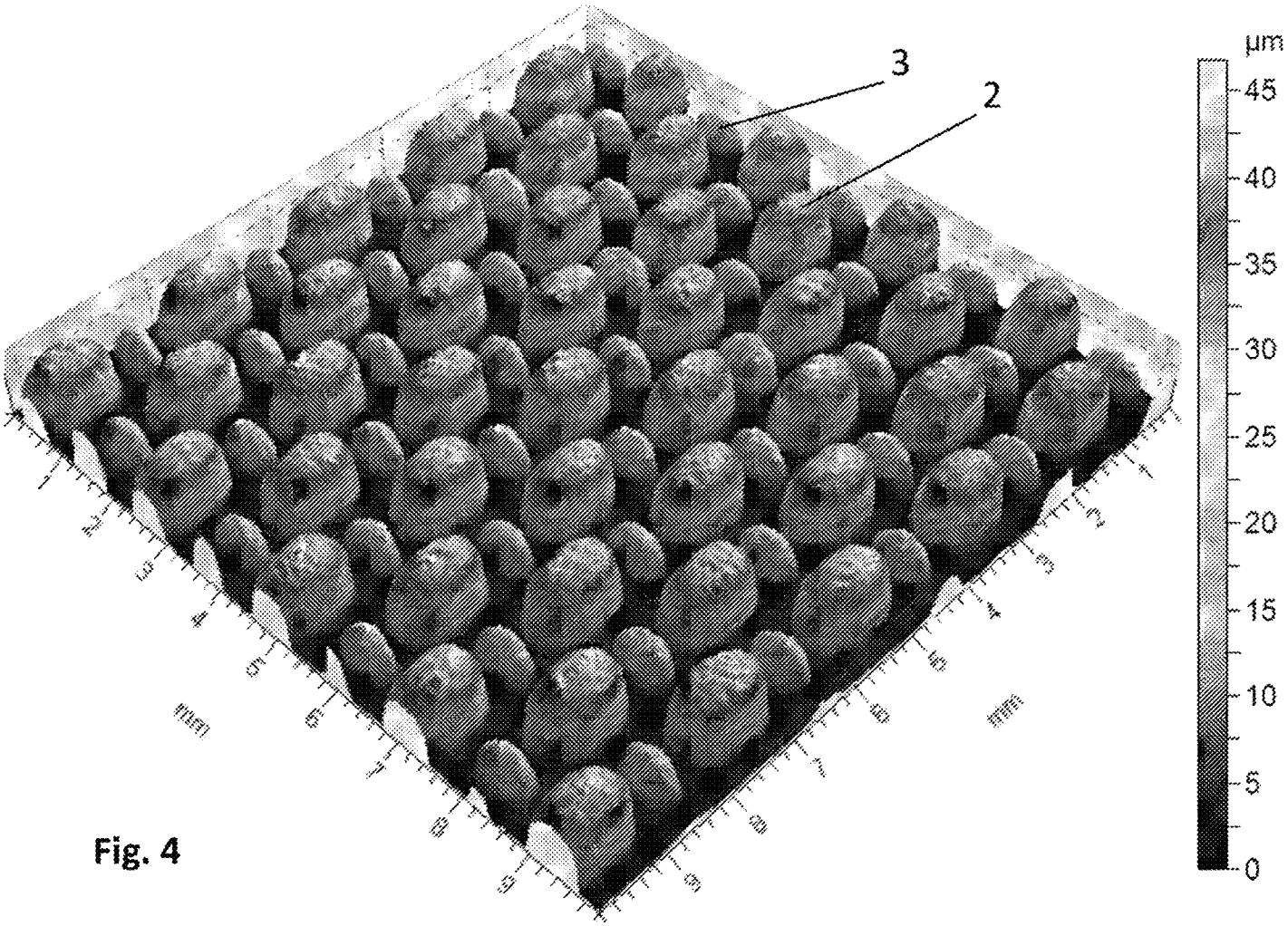

FIGS. 3 and 4 show a sheet surface etched with a pattern not according to the invention. It includes raised parts according to two interleaved regular arrays.

A first array, oriented along the rolling direction, includes reliefs 2 with a height of 45 μm, and a substantially elliptical section whereof, at the base, the large axis measures 1.25 mm and the small axis measures 0.85 mm. They are positioned in staggered rows, along lines separated by 1.13 mm. The section of each raised part decreases gradually along the height of the raised part, and the apices of two adjacent raised parts 2 situated on a same line are separated by 2 mm.

A second array, oriented in the crosswise direction, includes raised parts 3, inserted regularly between the raised parts 2 of the first array. The raised parts 3 have a height of 30 μm and a substantially elliptical section whereof, at the base, the large axis measures 0.88 mm and the small axis measures 0.57 mm. They are positioned in staggered rows, along lines separated by 1 mm. The section of each raised part decreases gradually according to the height of the raised part, and the apices of two adjacent raised parts 3 situated on a same line are separated by 2.26 mm.

The spectral analysis diagram of this surface shows that its isotropy is 40.9%, which is relatively high and could be favorable in terms of absence of fingerprint visibility. However, this diagram shows only three favored directions of 16°, 89.9° and 160° relative to the crosswise direction. These deviations are very significant, greater than the maximum of 60° required by the invention, and we will see that indeed, the fingerprints remain highly visible on a stainless steel surface with this etching.

Figure 5:
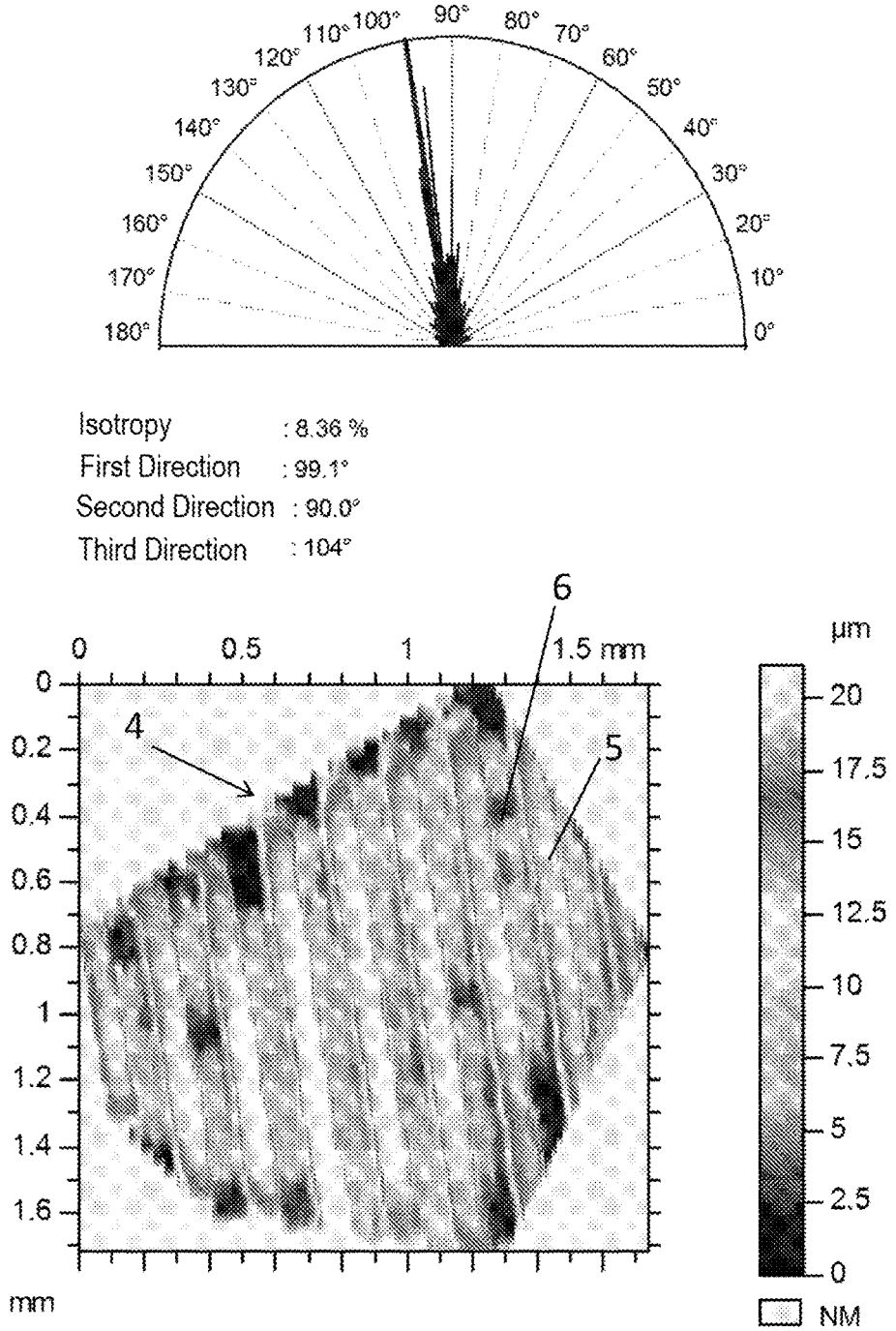
FIGS. 5 to 7, which show examples of isolated polygons, belonging to etching done on a stainless steel sheet according to the invention, with their respective spectral analysis diagrams.
Figure 6:
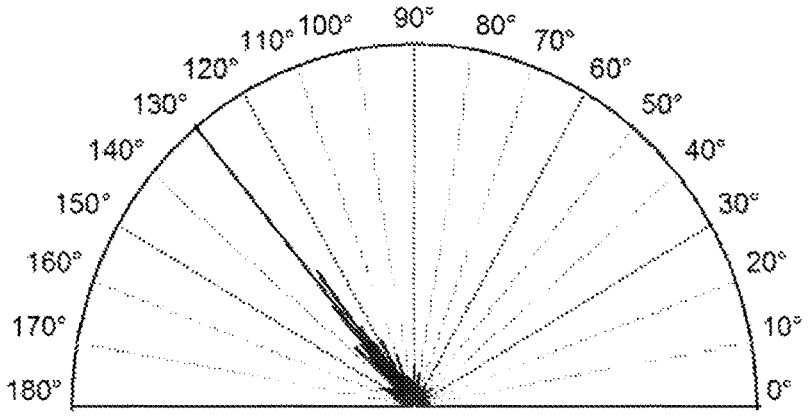
Figure 6:
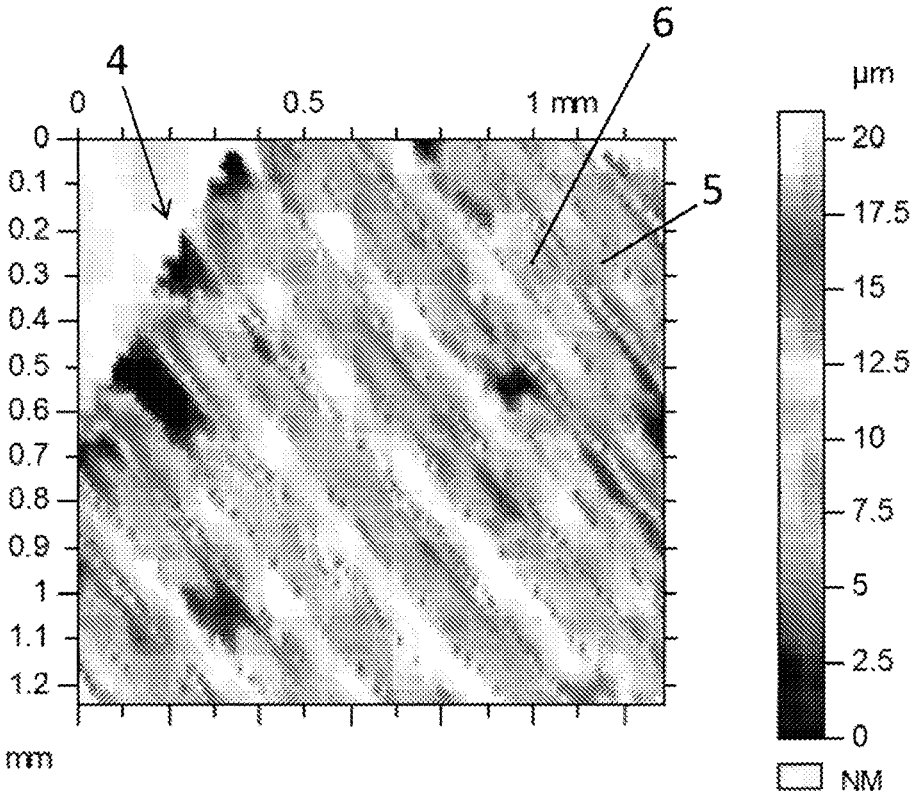
Figure 7:
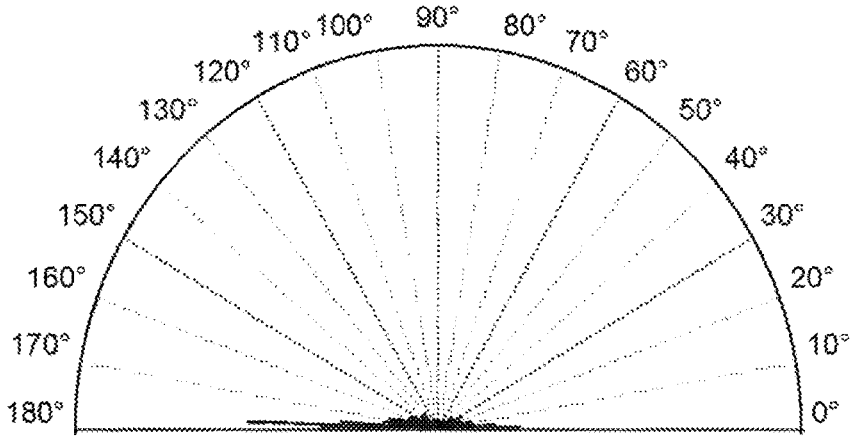
Figure 7:
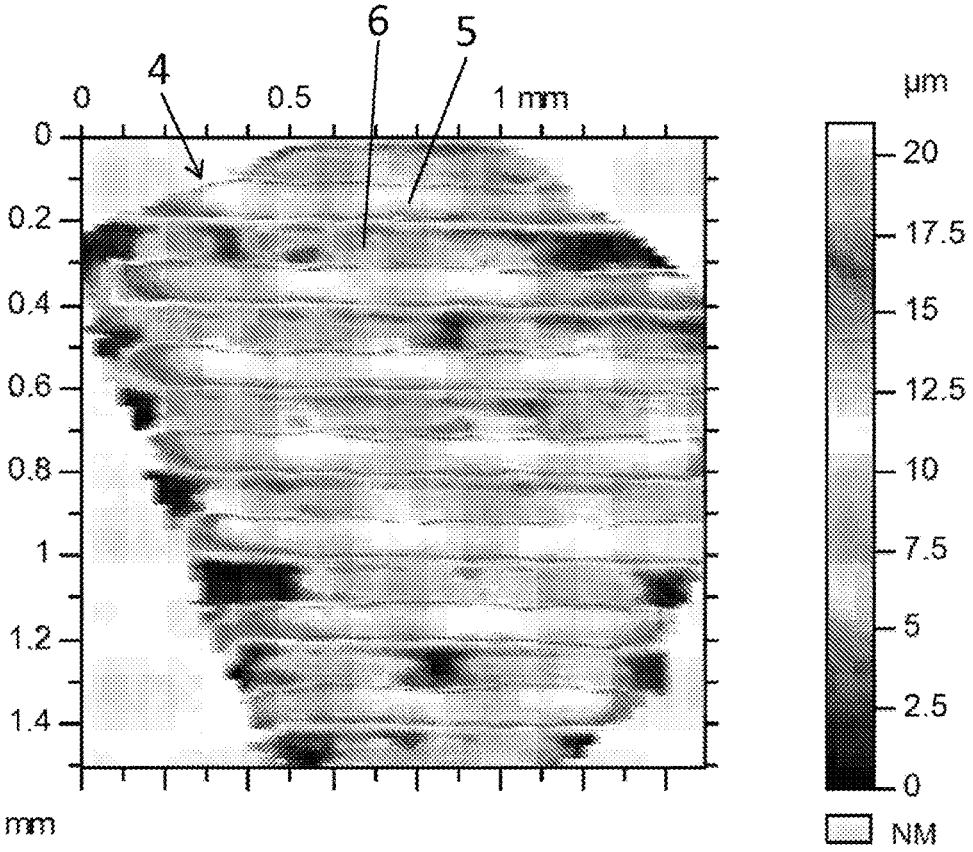

FIGS. 5 to 7 show the isolated polygon surfaces 4 belonging to a pattern imparted on the surface of the object, carried out according to the invention. As can be seen, these polygons 4 are, in the illustrated cases, irregular hexagons, within the limits of which rectilinear scratches 5 are arranged, which in turn are separated by ridge lines 6. The axes of each scratch 5 are separated by about 0.2 mm in the illustrated example, and according to the invention, this distance may vary between 0.1 and 0.3 mm. The depth of the scratches 5 relative to the apices of the ridges 6 is about 20 μm in the illustrated example. According to the invention, it may be from 5 to 30 μm. FIGS. 5 to 7 also show the Fourier transform spectral analysis diagrams of the corresponding isolated polygon 4.

FIG. 5 shows a polygon 4 whereof the axis of the scratches 5 is oriented nearly parallel to the rolling direction. The isotropy rate between the rolling direction and the crosswise direction is 8.36%, and is therefore very low, reflecting a very pronounced orientation of the scratches as a whole. The main favored direction is in fact in the 99.1° direction relative to the crosswise direction, a second favored direction is in the 90° direction, and a third favored direction is in the 84.3° direction.

FIG. 6 shows a polygon 4 identical to that of FIG. 3, for which the axis of the scratches is oblique (about 45°) relative to the rolling direction. The isotropy rate is 4.92%. The main favored direction is in the 130° direction relative to the crosswise direction, a second favored direction is in the 136° direction, and a third favored direction is in the 123° direction.

FIG. 7 shows a polygon 4 identical to that of FIG. 3, for which the axis of the scratches 5 is substantially perpendicular to the rolling direction. The isotropy rate is 7.08%. The main favored direction is in the 0.0729° direction relative to the crosswise direction, a second favored direction is in the 171° direction, and a third favored direction is in the 166° direction.

Figure 8:
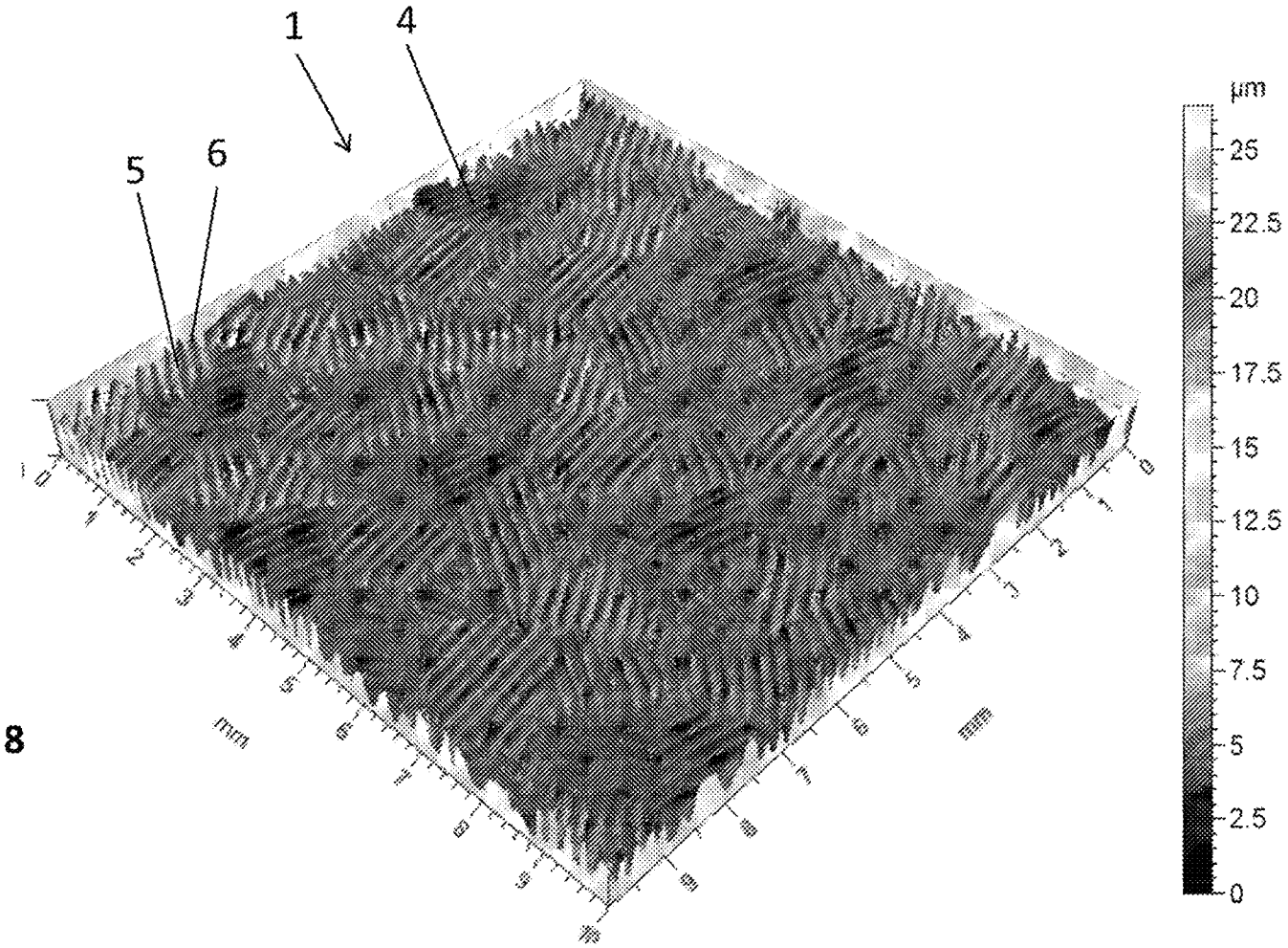
FIG. 8, which shows a perspective view of an example surface portion of a stainless steel sheet etched according to the invention.
Figure 9:
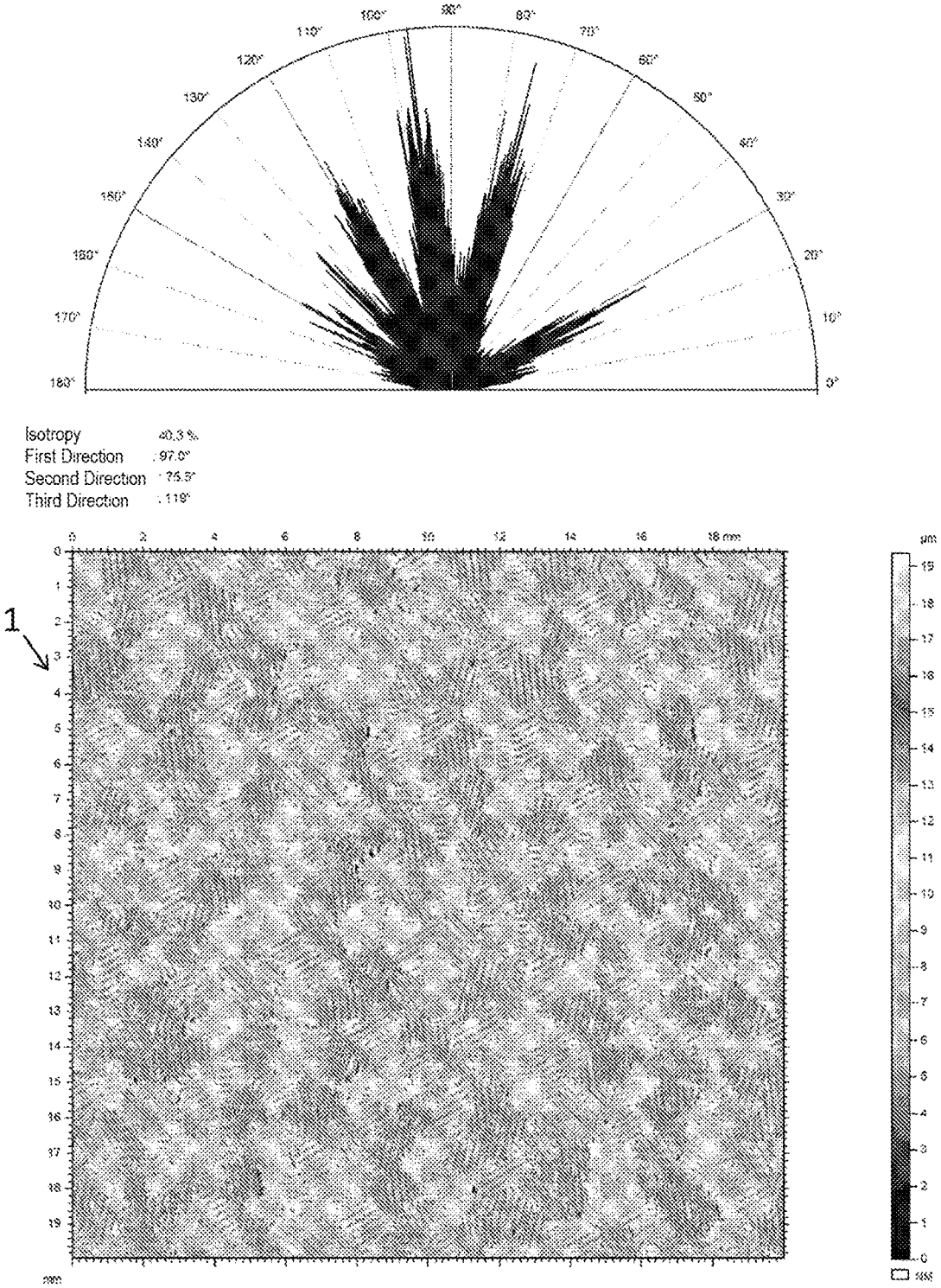
FIGS. 9 to 12, which show top views of examples of stainless steel sheet surface portions etched according to the invention, with their respective spectral analysis diagrams.

FIG. 8 shows a perspective view of a portion of the surface of a sheet 1 according to the invention, the surface of which has a random juxtaposition of polygons 4 as defined above. One can see therein that the contours and the orientations of the scratches of the different polygons 4 are quite varied, such that it must be expected that the isotropy rate of the surface as a whole will be relatively high, which is confirmed by the measurements that will be seen later. One can also see therein that, according to one preferred alternative of the invention, the polygons 4 are not all situated in the same plane, and that the reference planes of two adjacent polygons are inclined 5 by 1 to 10° relative to one another. FIG. 9 shows a top view of a 400 $mm^2$ portion of the surface of a sheet 1 according to the invention, with its Fourier transform spectral analysis diagram. The measurements of the isotropy rate between the rolling direction and the crosswise direction and preferred angular orientations are, like in FIGS. 1, 2 and 3, done on the entire depicted surface, and not, as in FIGS. 5 to 7, on isolated polygons. The isotropy is therefore substantially more pronounced, since the favored orientations of the scratches of the various polygons are quite varied: 40.3%. The scratches of the preferred orientations of the surface taken as a whole form a stack of six groups of scratches, these groups having clearly different main orientations. There is therefore no longer one favored, practically unique orientation along the rolling direction like in the reference examples of FIGS. 1 and 2. The three favored orientations are respectively at 97.0°, 75.5° and 119°, and are therefore quite clearly different from one another, since between two adjacent favored orientations there is a deviation of 21.5° and 22°, respectively. However, the deviation between these three favored directions is significantly smaller than in the case of the reference etching, not according to the invention, of FIGS. 3 and 4.

Figure 10:
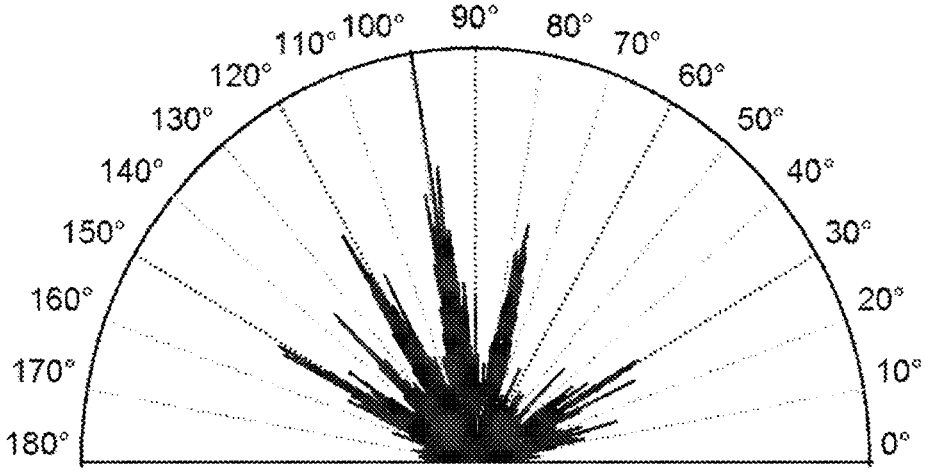
Figure 10:
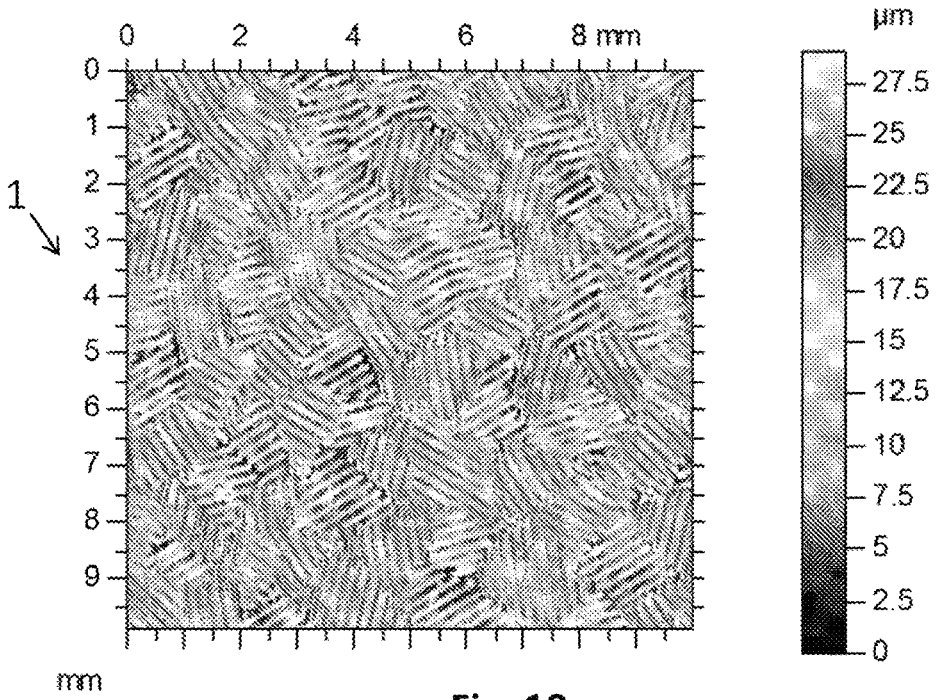

FIG. 10 shows another example surface of a sheet 1 according to the invention. Its isotropy is 53.3%, therefore even better than for the example of FIG. 7. Seven favored orientations are visible on the spectrum, the three main ones of which are separated by 21.8° and 22.2° relative to their neighbor(s), as shown by the data from the diagram.

Figure 11:
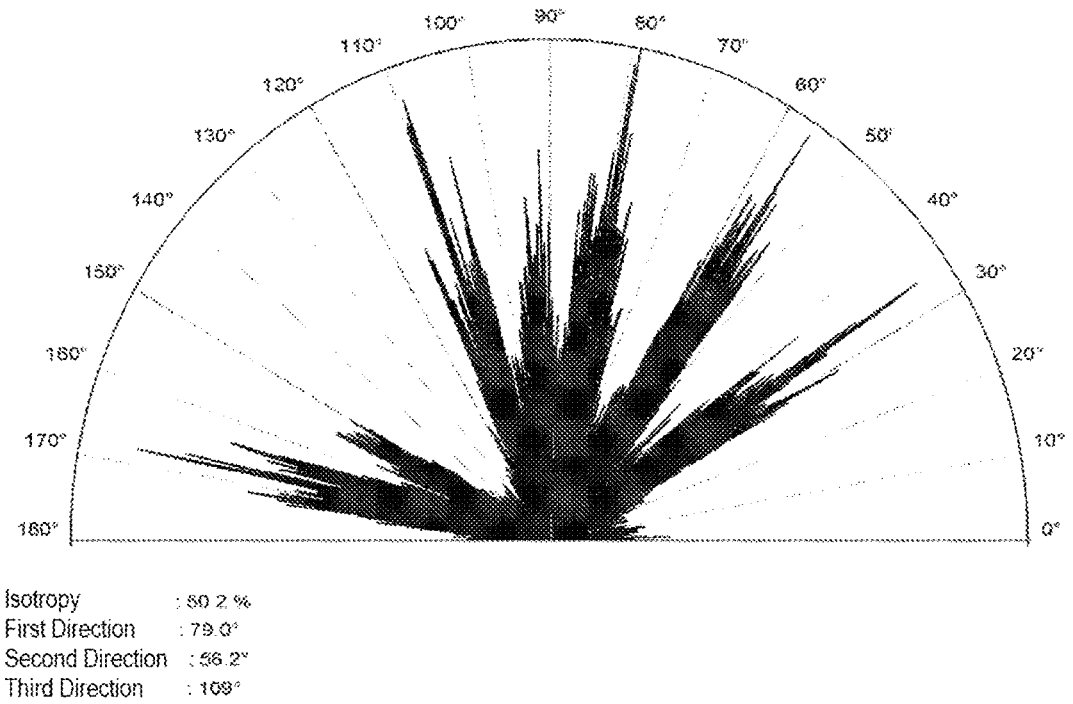
Figure 11:
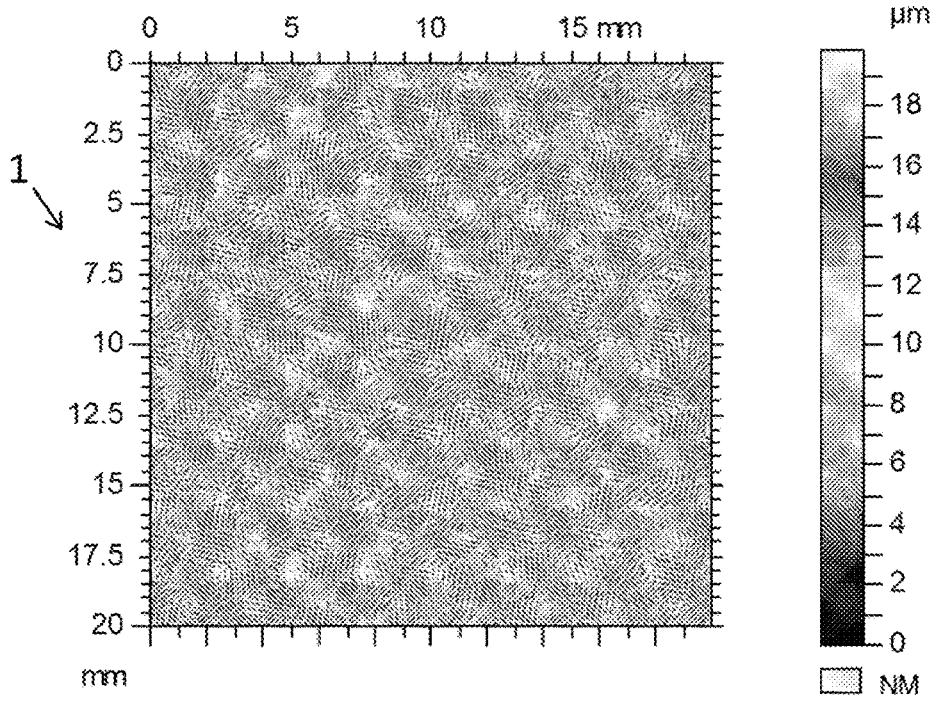

FIG. 11 shows another example surface of a sheet 1 according to the invention. Its isotropy is 50.2%. Seven favored orientations are visible on the spectrum, the three main ones of which are separated by 22.8° and 30° relative to their neighbor(s), as shown by the data from the diagram.

Figure 12:
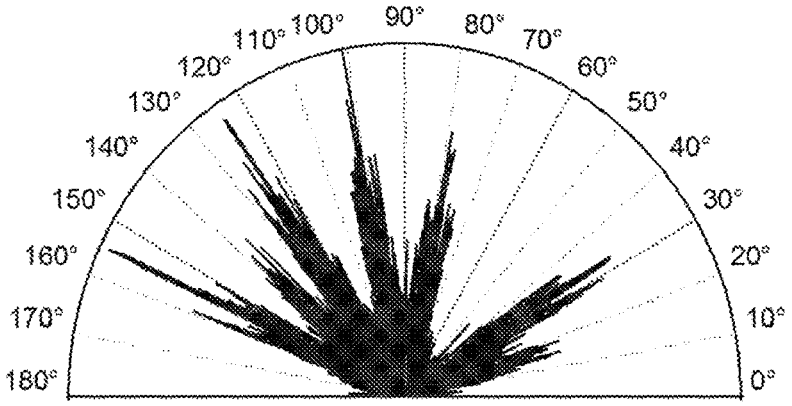
Figure 12:
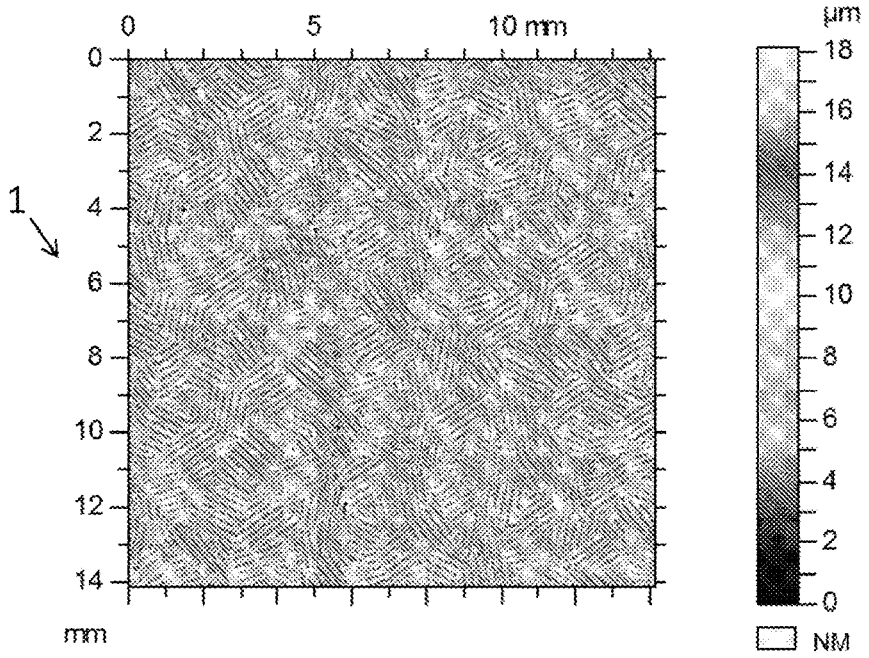

FIG. 12 shows another example surface of a sheet 1 according to the invention. It in particular shows a large number of polygons having four sides. Its isotropy is 60.5%, therefore even better than those of the other examples shown in FIGS. 7 to 9. Seven favored orientations are visible on the spectrum, the three main ones of which are separated by 54° and 30° relative to their neighbor(s), as shown by the data from the diagram.

Figure 13:
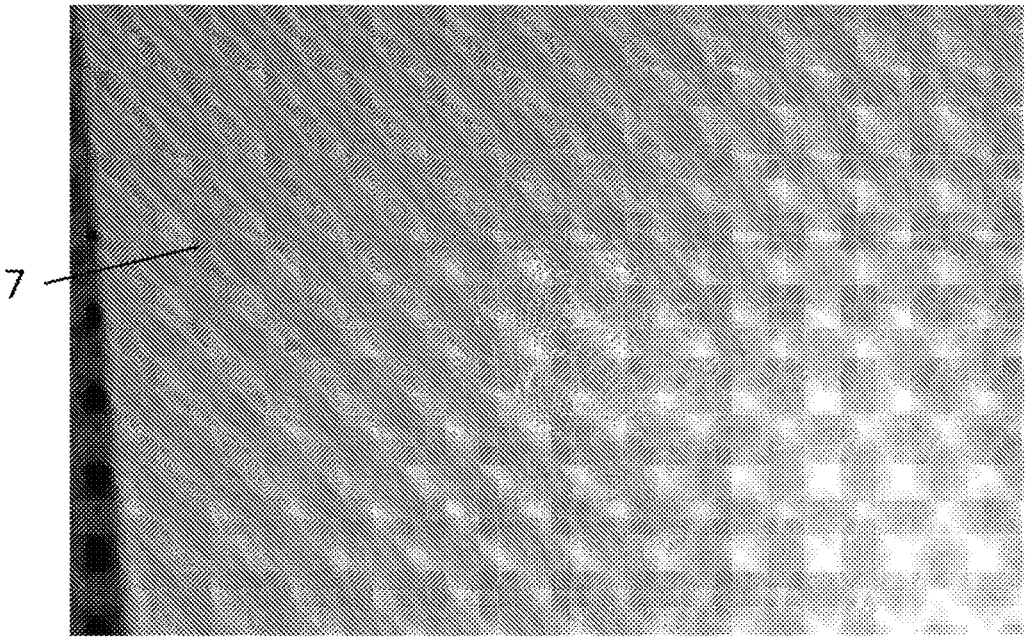
FIG. 13, which shows the surface of a reference stainless steel sheet with an unetched surface, on which a fingerprint is visible.

FIG. 13 shows the smooth reference surface 7 of a sheet made from a stainless steel of type AISI 304 having undergone glossy annealing, on which a user has left a clearly visible fingerprint.

Figure 14:
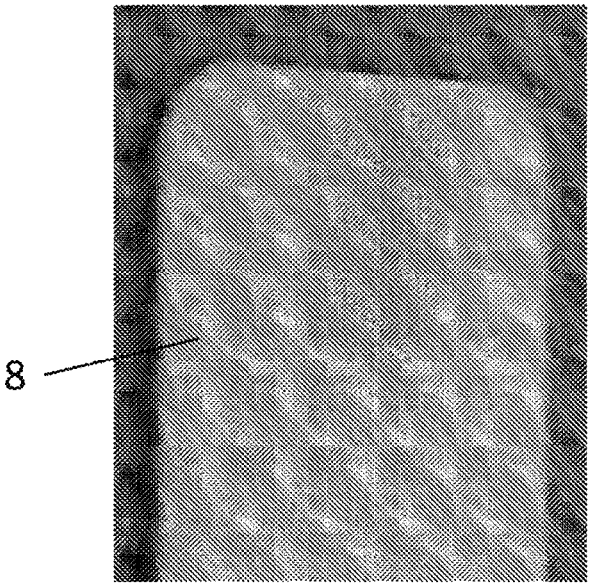
FIG. 14, which shows, with the same magnification as FIG. 13, the surface of a reference stainless steel sheet with a surface etched according to FIGS. 3 and 4, on which a fingerprint is visible.

FIG. 14 shows, with the same magnification as FIG. 13, the surface 8 of a sheet made from a stainless steel of type AISI 304 having undergone glossy annealing, on which a user has also left a clearly visible fingerprint, although this surface 8 has etching according to that shown in FIGS. 3 and 4. It is therefore clear that not any type of etching of the surface of the stainless steel sheet can resolve the problem of alleviating the visibility of fingerprints in a satisfactory manner.

Figure 15:
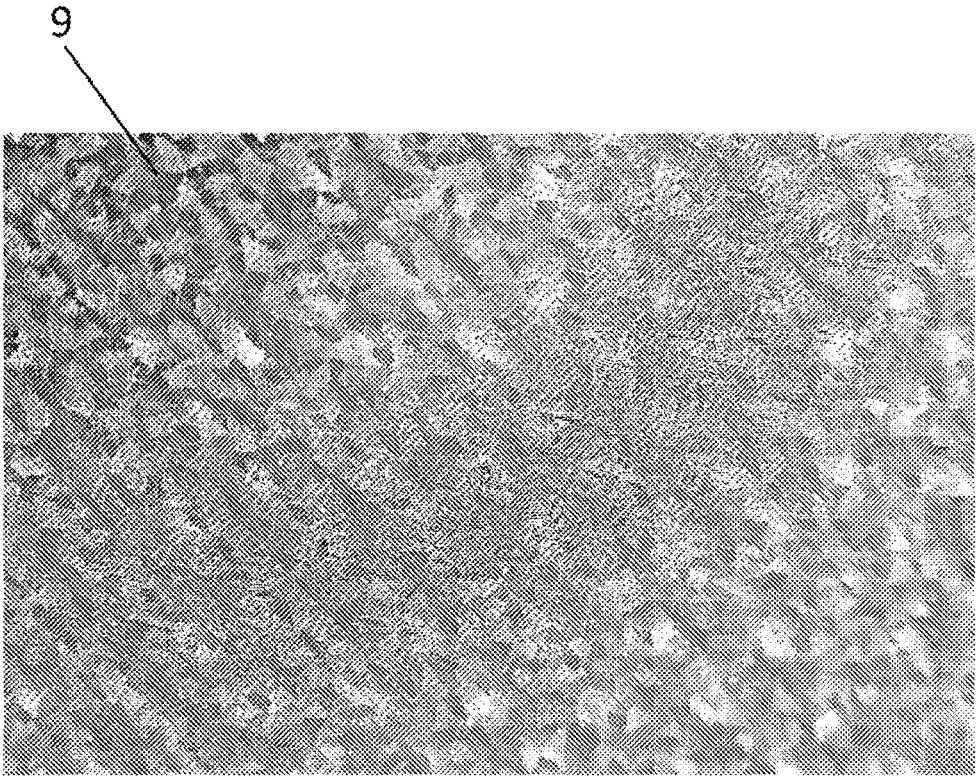
FIG. 15, which shows, with the same magnification as FIG. 13, the surface of a stainless steel sheet etched according to the invention, and on which a fingerprint is substantially not visible.

FIG. 15 shows, with the same magnification as FIG. 13, the surface 9 of a stainless steel sheet of the same type as that of FIG. 13 and observed under the same lighting conditions, the surface of which is etched according to the present invention (this is the type of etching of FIG. 12) and on which a user has also placed a finger. Here, this fingerprint is not visible as such, and is reflected only by the presence of a slightly darker zone, which is a sign of a slightly lower light reflection than on the remainder of the surface of the sheet. The aesthetic appearance of the surface 9, in particular its gloss, is therefore not substantially modified for a viewer looking at it from a typical distance.

It is preferable for the flanks of the scratches 5 not to be rectilinear, but to have a curved surface and/or, better still, unevenness. In this way, the diffusion of the light leaving the scratches 5 is more random, which accentuates the desired effect of alleviating the visibility of fingerprints.

The invention may apply to all types of stainless steels, irrespective of their microstructure. It is particularly interesting to use for steels that undergo a glossy annealing, and on which fingerprints are most visible. However, steels treated by traditional annealing, and for which glossiness of the surface is also obtained, may also advantageously benefit from the invention.

What is claimed is:

1. A rolled stainless steel object, wherein the surface thereof has a raised and indented pattern including a random juxtaposition of at least two types of polygons, each of said polygons having at least three sides, a surface area of between 1 and 9 $mm^2$, and a difference between its smallest and largest dimensions of between 0.5 and 3 mm, each polygon being made up of substantially parallel rectilinear scratches, each separated by ±15° relative to the mean orientation of the scratches, having a depth of from 5 to 30 μm separated by ridge lines, and the axes of which are from 0.1 to 0.3 mm from each other, each polygon of the pattern has a reference plane, said reference plane represents the orientation of the polygon in space, the scratches have flanks, and a Fourier transform spectral analysis of which, carried out on a square of at least 100 $mm^2$, shows that they have an isotropy of at least 40% between the rolling direction and the sideways direction, and two adjacent preferred angular orientations of which scratches, from among the three main preferred angular orientations thereof, are spaced apart by a minimum of 20° and a maximum of 60°.

2. The object according to claim 1, wherein the reference plane of each polygon is inclined relative to the reference planes of its adjacent polygons, from 1 to 10°.

3. The object according to claim 1, wherein the flanks of said scratches have curved surfaces and/or surfaces including unevenness.

4. The object according to claim 1, wherein said object involves a sheet, plate or strip.

5. The object according to claim 4, wherein the sheet, plate or strip, constituting a precursor of said object, is cut and/or shaped.

6. A method for manufacturing an object according to claim 1, wherein said surface having said pattern is obtained during the rolling of the object, or a precursor of said object, by the pressure of a rolling cylinder on the surface of the object or its precursor, said cylinder in turn having, on its surface, a pattern making it possible to obtain said pattern on the surface of the object.

* * * * *